US011781825B2

(12) United States Patent
Puha et al.

(10) Patent No.: US 11,781,825 B2
(45) Date of Patent: Oct. 10, 2023

(54) GAS BLOCK FOR A FIREARM

(71) Applicant: Eight Holdings LLC, Coeur D-Alene, ID (US)

(72) Inventors: Teodor Puha, Coeur D-Alene, ID (US); Edmund Ziegler, Coeur D-Alene, ID (US)

(73) Assignee: Eight Holdings LLC, Coeur d'Alene, ID (US)

( * ) Notice: Subject to any disclaimer, the term of this patent is extended or adjusted under 35 U.S.C. 154(b) by 0 days.

(21) Appl. No.: 17/578,133

(22) Filed: Jan. 18, 2022

(65) Prior Publication Data

US 2022/0307783 A1 Sep. 29, 2022

Related U.S. Application Data

(60) Provisional application No. 63/138,592, filed on Jan. 18, 2021.

(51) Int. Cl.
*F41A 5/26* (2006.01)
*F41A 5/28* (2006.01)

(52) U.S. Cl.
CPC . *F41A 5/28* (2013.01); *F41A 5/26* (2013.01)

(58) Field of Classification Search
CPC ..... F41A 5/18; F41A 5/26; F41A 5/28; F41A 5/22; F41A 5/24; F16L 19/06; F16L 19/065; F16L 21/007
See application file for complete search history.

(56) References Cited

U.S. PATENT DOCUMENTS 1,955,831 A * 4/1934 Raybould ..... F16L 19/08 277/622
3,123,929 A * 3/1964 Pachmayr ..... F41A 21/40 42/79
3,239,247 A * 3/1966 Pickert ..... F16L 19/061 285/348
4,230,349 A * 10/1980 Normark ..... F16L 19/061 285/382.7
7,032,935 B1 * 4/2006 Levy ..... F16L 19/06 285/341
8,161,864 B1 * 4/2012 Vuksanovich ..... F41A 5/26 89/193
8,960,069 B1 * 2/2015 Soong ..... F41A 5/28 89/193
9,016,732 B2 * 4/2015 Bearer ..... F16L 19/065 285/353
11,287,200 B1 * 3/2022 Oglesby ..... F41A 21/325
(Continued)

*Primary Examiner* — Gabriel J. Klein
(74) *Attorney, Agent, or Firm* — Eric B. Fugett; Mark A Pitchford; Pitchford Fugett, PLLC

(57) ABSTRACT

A gas block for AR-platform firearms is provided which is easier to install and index on a barrel of the firearm by utilizing a wedge (e.g., collet) system. The body of the gas block may therefore be relatively precisely circular, allowing for easy movement into position on the barrel of the firearm. The gas block is stronger, tighter, more durable, and more reliably stays in place than prior art gas blocks. In one embodiment, the gas block eliminates forward gas leakage from between the gas block and barrel. The gas block is interchangeable with standard prior art gas blocks commonly found on barrels of existing AR-platform firearms. The gas block is also compatible with low profile and MLOK handguards for AR-platform firearms.

15 Claims, 11 Drawing Sheets

(56) References Cited

U.S. PATENT DOCUMENTS

| | | | | |
|---|---|---|---|---|
| 2006/0283318 | A1* | 12/2006 | Beaty | F41A 21/28<br>89/193 |
| 2011/0179945 | A1* | 7/2011 | Clark | F41A 5/18<br>89/193 |
| 2014/0033590 | A1* | 2/2014 | Gomez | F41A 5/26<br>42/75.02 |
| 2017/0336159 | A1* | 11/2017 | Kitchen | F41A 5/26 |
| 2022/0221238 | A1* | 7/2022 | Salinas | F41A 5/28 |

* cited by examiner

GAS BLOCK FOR A FIREARM

CROSS-REFERENCES TO RELATED APPLICATIONS

This application claims priority to and hereby incorporates by reference in its entirety U.S. Provisional Patent Application Ser. No. 63/138,592 entitled "GAS BLOCK FOR A FIREARM" filed on Jan. 18, 2021.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to firearms. More specifically, the present invention relates to gas blocks for firearms.

Currently available gas blocks for AR-platform firearms are typically attached to the barrel of the firearm using a pair of set screws. The set screws extend vertically upward through a bottom wall of the gas block body to contact a bottom (i.e., lower) surface of the barrel. Tightening the set screws fixes the gas block body onto the barrel by friction between the screw ends and the barrel surface. Other currently available gas blocks attach to the barrel using a pinch mount system in which the bottom wall of the gas block body is split from front to back. A pair of pinch or clamp screws typically extend laterally through the split bottom wall of the gas block body from side to side across the split. Tightening the pinch or clamp screws causes the two portions of the gas block body on either side of the split to draw closer together. The opposing sides of the gas block thereby clamp or "pinch" the gas block body onto the barrel. The gas block is held in place by friction between the opposing lateral sides (i.e., not the top and bottom) of the gas block. Both the set screw and split bottom gas block can be difficult to install and index relative to a gas port in the barrel. They are also known to become loose (especially when subjected to lateral percussive force) and leak propellant gas during use through both the front and back (front is end near muzzle and back is end near buttstock) of the gas block (i.e., from a small gap between the gas block and barrel). Accordingly, what is needed are improvements in gas blocks for firearms.

BRIEF SUMMARY OF THE INVENTION

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one aspect, a gas block for AR-platform firearms is provided which is easier to install and index on a barrel of the firearm by utilizing a wedge (e.g., collet) system. The body of the gas block may therefore be relatively precisely circular, allowing for easy movement into position on the barrel of the firearm. The gas block is stronger, tighter, more durable, and more reliably stays in place than prior art gas blocks. In one embodiment, the gas block eliminates forward gas leakage from between the gas block and barrel. The gas block is interchangeable with standard prior art gas blocks commonly found on barrels of existing AR-platform firearms. The gas block is also compatible with low profile and MLOK handguards for AR-platform firearms.

In one aspect, a gas block for a firearm includes a gas block body, a wedge, and an externally threaded nut. The gas block body includes a barrel passage, a tapered recess, and a threaded aperture. The barrel passage is configured to receive a barrel of the firearm therethrough. The barrel extends along the longitudinal axis. The gas block body extends along the longitudinal axis when the gas blocks installed on the firearm. The gas block body has a gas port in the barrel pass is configured to align with the gas orifice of the barrel when the gas block is installed on the firearm. The wedge is configured to be at least partially received in the tapered recess when the gas block is installed on the firearm. The externally threaded nut is configured to engage the threaded aperture of the gas block body and apply rearward pressure to the wedge when the gas block is installed on the firearm. Rearward is generally parallel with the longitudinal axis away from the muzzle of the firearm toward a receiver of the firearm.

In another aspect, a firearm includes a gas block. The gas block includes a gas block body, a wedge, and an externally threaded nut. The gas block body includes a barrel passage, a tapered recess, and a threaded aperture. The barrel passage is configured to receive a barrel of the firearm therethrough. The barrel extends along the longitudinal axis. The gas block body extends along the longitudinal axis when the gas blocks installed on the firearm. The gas block body has a gas port in the barrel pass is configured to align with the gas orifice of the barrel when the gas block is installed on the firearm. The wedge is configured to be at least partially received in the tapered recess when the gas block is installed on the firearm. The externally threaded nut is configured to engage the threaded aperture of the gas block body and apply rearward pressure to the wedge when the gas block is installed on the firearm. Rearward is generally parallel with the longitudinal axis away from the muzzle of the firearm toward a receiver of the firearm.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. As used herein, the upright position of a firearm is in a level firing position with the muzzle (or muzzle attachment) forming the forward end of the firearm, and the firearm extending rearward from the muzzle to the buttstock. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Figure 18:
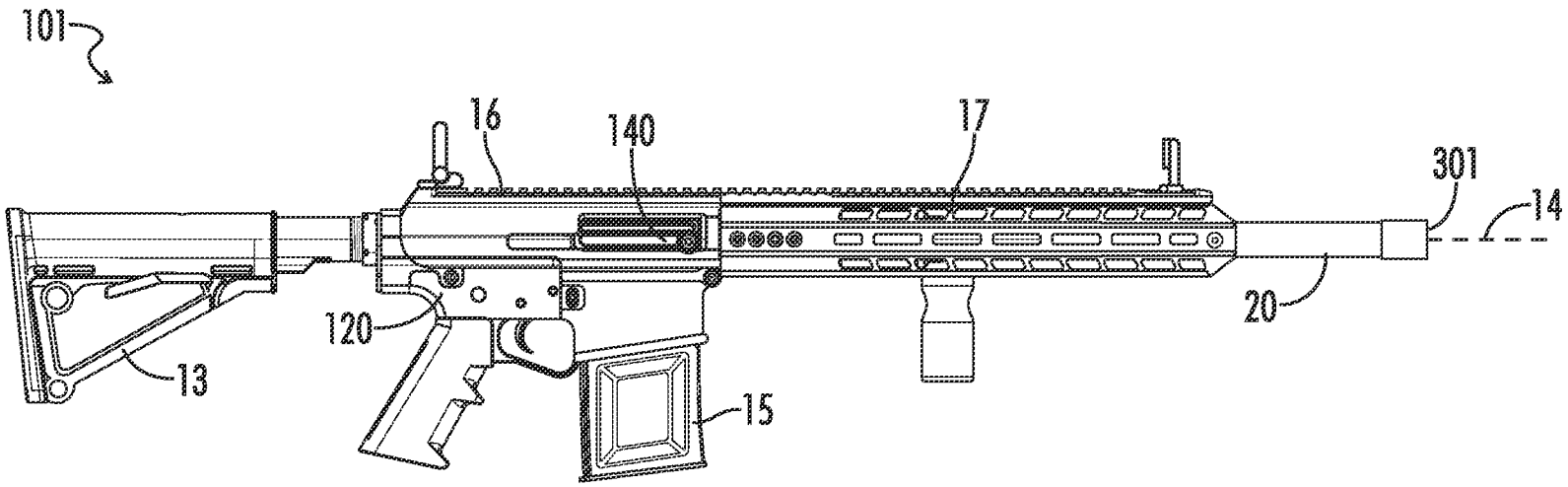
FIG. 18 is an isometric view of an AR platform firearm according to one embodiment of the invention.

Referring to FIG. 18, in one embodiment, a firearm 101 includes a buttstock 13, a receiver (120, 160), a bolt 140, a handguard 17, and a barrel 20. The receiver of the firearm 101 may include an upper receiver 160 and a lower receiver 120. The firearm 101 may also include a magazine 15 and optics or sights, as well as other accessories. The barrel 20 extends along a longitudinal axis 14. The handguard 17 generally surrounds (e.g., except for cutouts, access holes, vents, etc.) the barrel 20 along a portion of the barrel 20. The handguard 17 shown herein is a skeletonized handguard with a Picatinny or Weaver rail system, but it is contemplated within the scope of the disclosure and claims that the handguard 17 includes other types of handguards 17 such as generally continuous cylindrical barrel shrouds and handguards including multiple or no rail systems and/or keymod holes.

Figure 1:
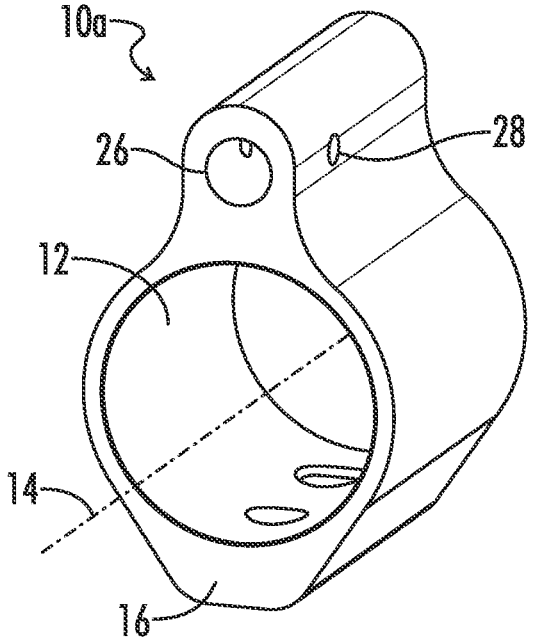
FIG. 1 (PRIOR ART)
FIG. 1 is a front isometric view of a prior art gas block for an AR-platform firearm.
Figure 2:
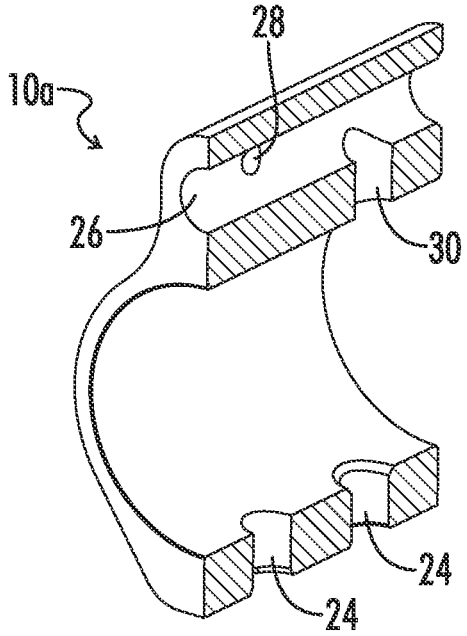
FIG. 2 (PRIOR ART)
FIG. 2 is a cutaway view taken vertically along a longitudinal axis of the gas block of FIG. 1.
Figure 3:
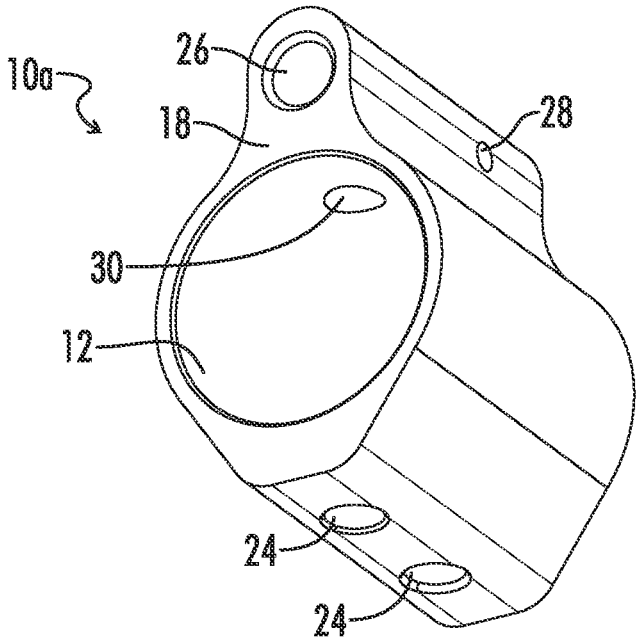
FIG. 3 (PRIOR ART)
FIG. 3 is a rear isometric view of the gas block of FIG. 1.

Referring now to FIGS. 1-3, there is shown an exemplar prior art gas block 10*a* for an AR platform firearm (not shown). The gas block 10*a* includes a barrel passage 12 extending along a longitudinal axis 14 and extending from a front surface 16 to a rear surface 18 thereof. A barrel 20 for the AR platform firearm 101 is receivable through the barrel passage 12. Exemplar AR platform barrels 20 include a gas orifice 22 in fluid communication with a bore 23 of the barrel. A pair of longitudinally spaced screw holes 24 are defined through a bottom wall of the gas block 10*a*. Set screws (not shown) are receivable in the screw holes 24 to fix the gas block 10*a* to the barrel 20 when the barrel 20 is received in the barrel passage 12. A gas tube passage 26 extends through an upper portion of the gas block 10*a* above and parallel to the barrel passage 12 (and longitudinal axis 14). The gas tube passage 26 is in fluid communication with the gas port 30 of the gas block body 10*a*. A retainer pin hole 28 extends laterally from side to side through a forward portion of the gas block 10*a* and intersects the gas tube passage 26. A gas port 30 extends between and fluidly connects the barrel passage 12 with the gas tube passage 26.

A gas tube 32 for an AR platform firearm is receivable in the gas tube passage 26. Exemplar gas tubes 32 include a gas orifice 34 and a retainer pin hole 36. When the gas tube 32 is received in the gas tube passage 26 and the barrel 20 is received in the barrel passage 12, the gas orifice 25 of the barrel aligns with the gas port 30 of the gas block 10*a* and the gas port 30 aligns with the gas orifice 34 of the gas tube 32 such that the bore 23 of the barrel 20 is in fluid communication with the gas tube 32. When assembled properly, the gas block and gas tube retainer pin holes 28, 36, respectively, should also be aligned. A retainer pin (not shown), which can be a roll pin, is receivable through the aligned retainer pins holes 28, 36 to releasably retain the gas tube 32 in the gas tube passage 26 of the gas block 10*a* and keep the gas orifice 34 in the gas tube 32 aligned with the gas port 30 in the gas block 10*a*.

Figure 4:
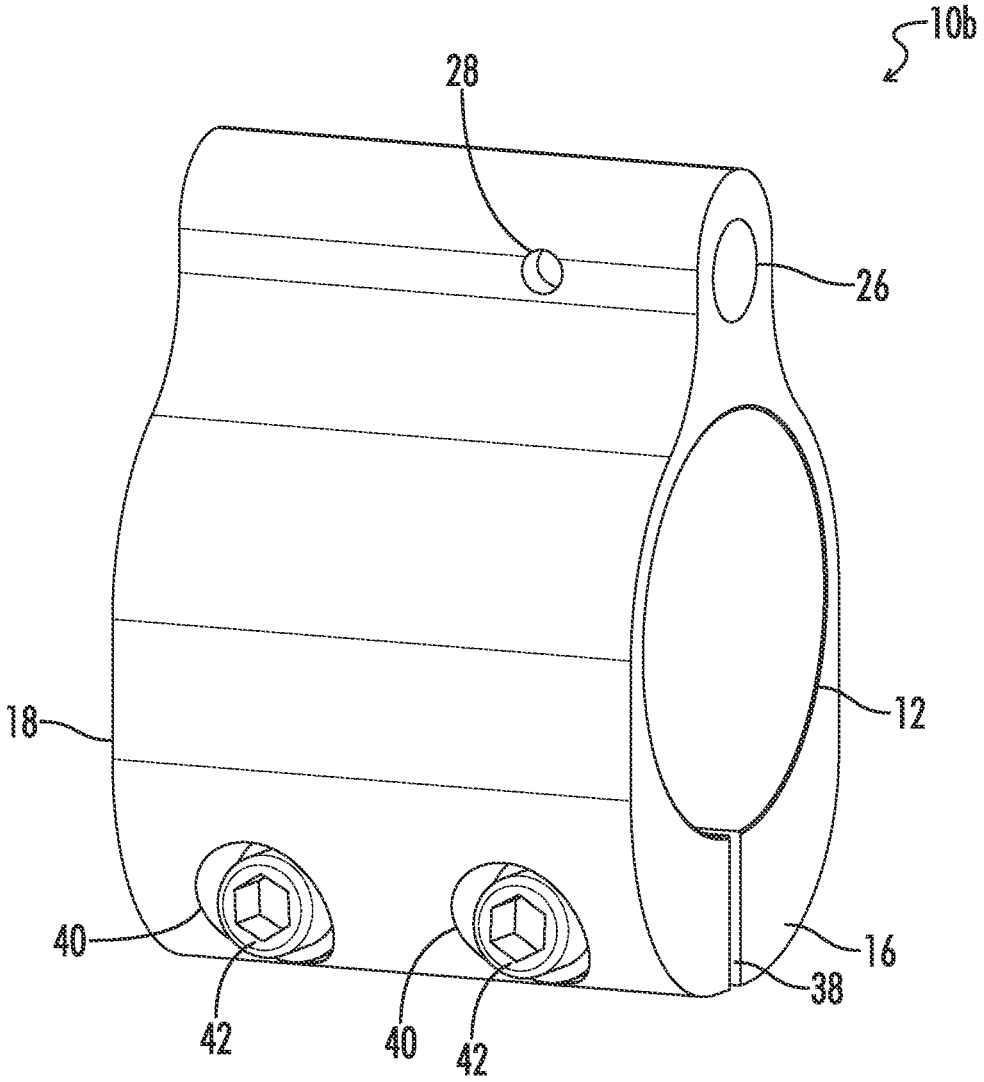
FIG. 4 (PRIOR ART)
FIG. 4 is a front and side perspective view of another prior art gas block for an AR-platform firearm.
Figure 5:
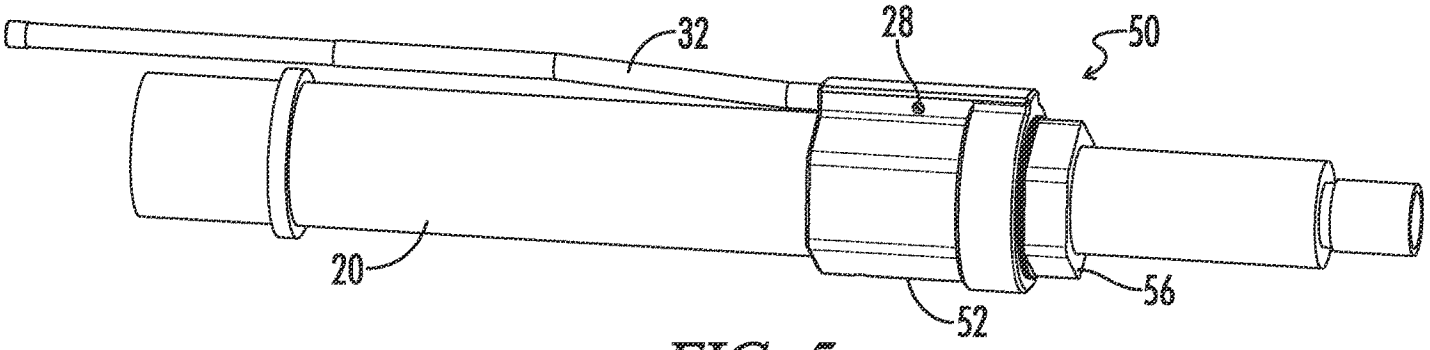
FIG. 5 is an elevated side perspective view of one embodiment of a gas block for a firearm constructed in accordance with the present invention showing the gas block installed on a barrel for an AR platform firearm with a gas tube for the AR platform firearm received in the gas block.
Figure 6:
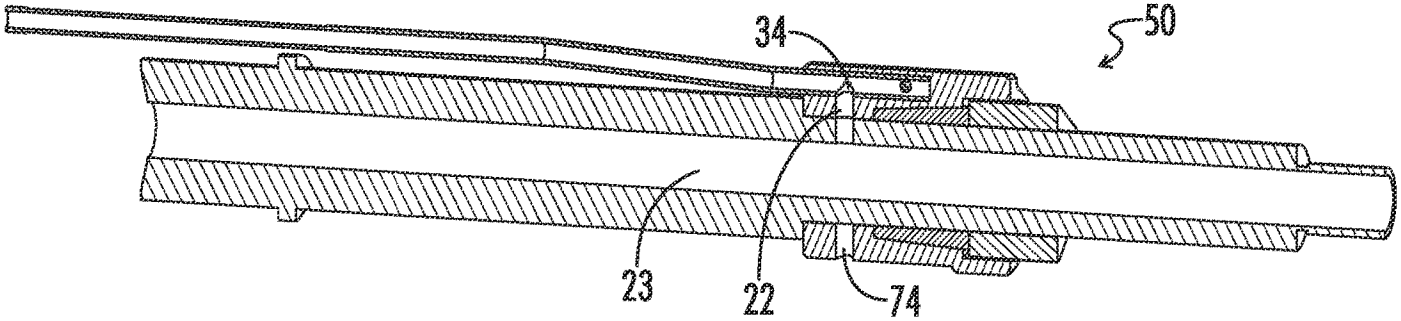
FIG. 6 is a side cutaway view of the objects of FIG. 5 taken vertically along the longitudinal axis of the barrel.
Figure 7:
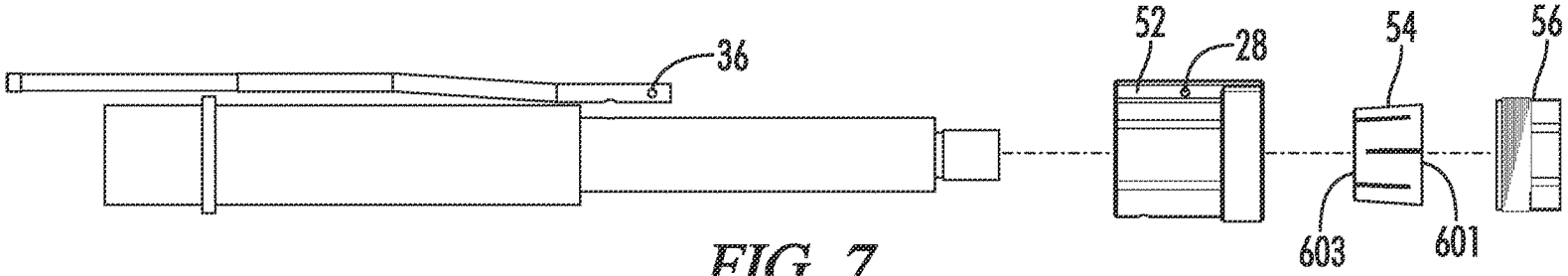
FIG. 7 is an exploded side elevation view of the objects of FIG. 5.
Figure 8:
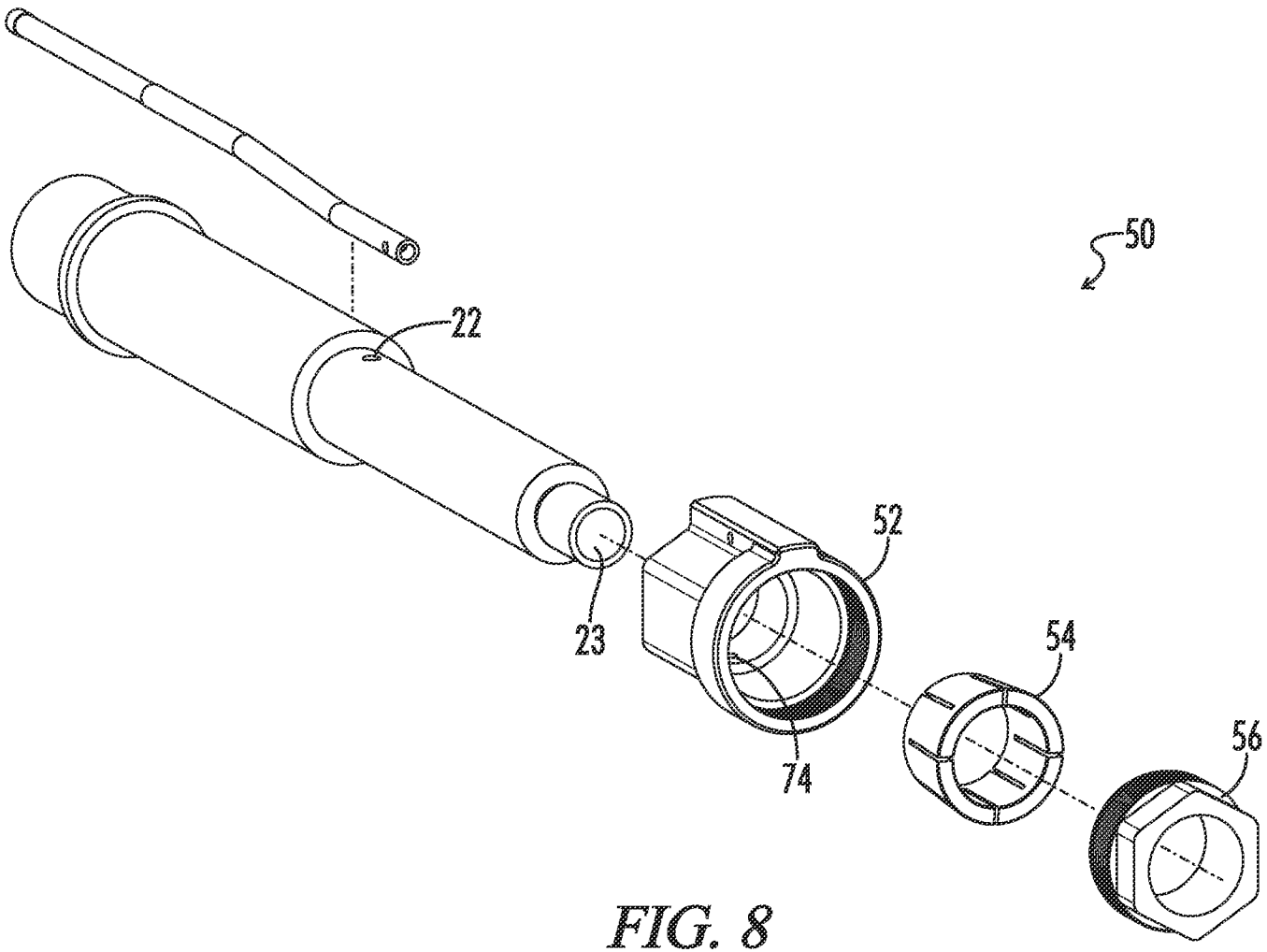
FIG. 8 is an exploded front isometric view of the objects of FIG. 5.
Figure 9:
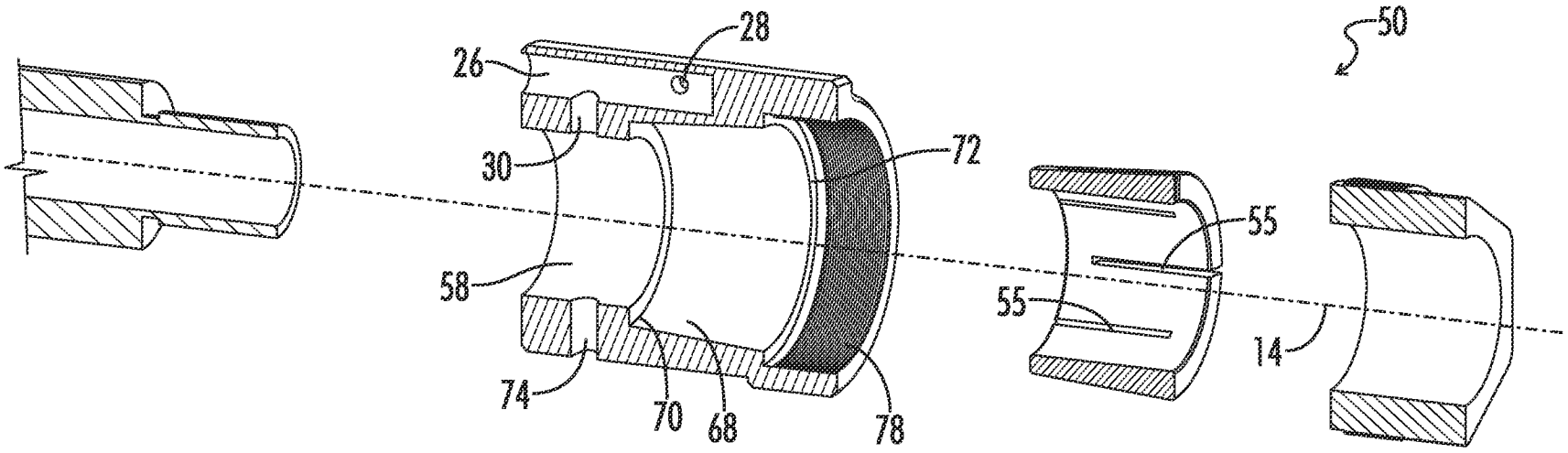
FIG. 9 is an exploded cutaway isometric view of the objects of FIG. 5 taken vertically along the longitudinal axis of the barrel.
Figure 10:
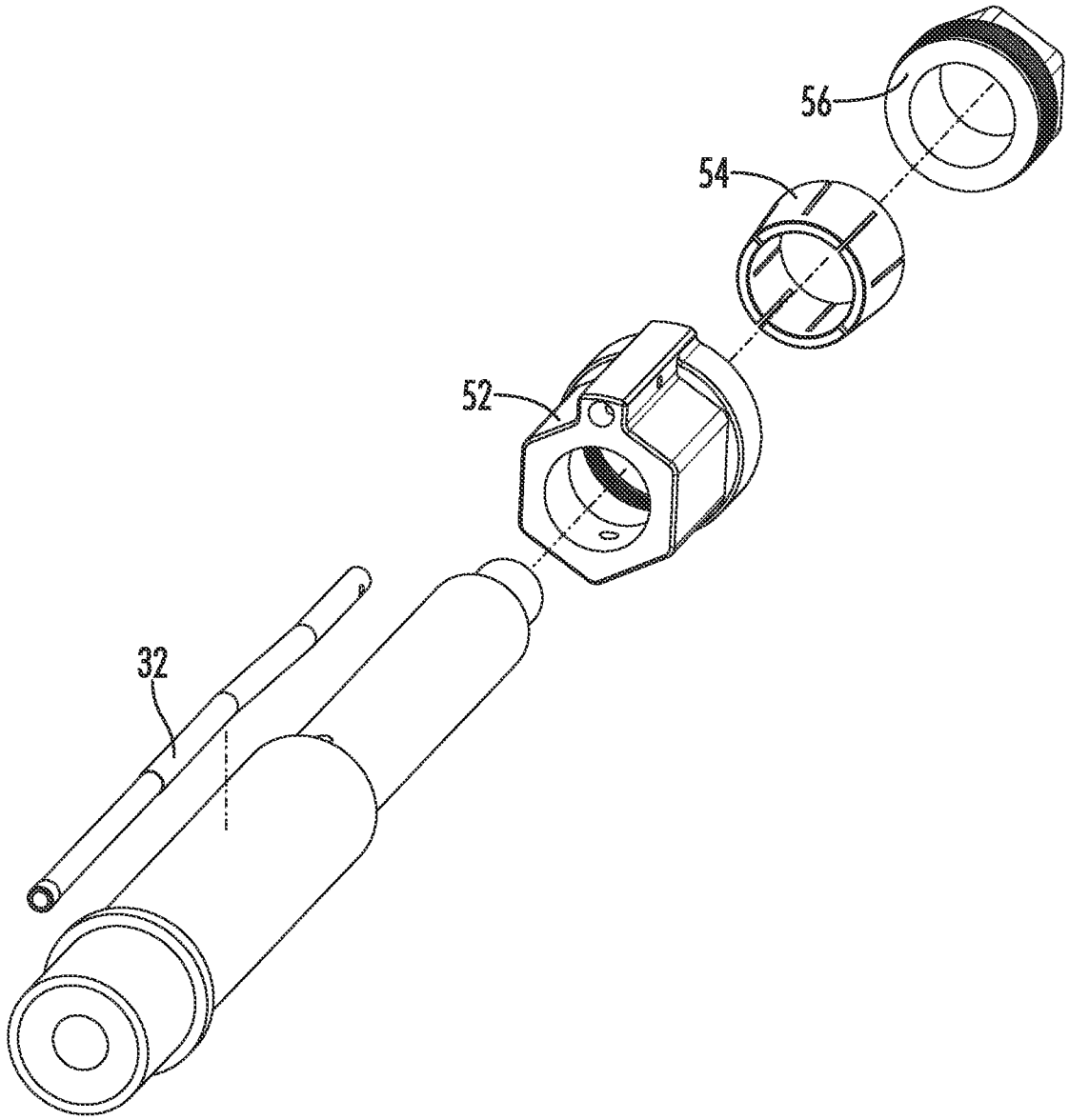
FIG. 10 is an exploded rear isometric view of the objects of FIG. 5.
Figure 11:
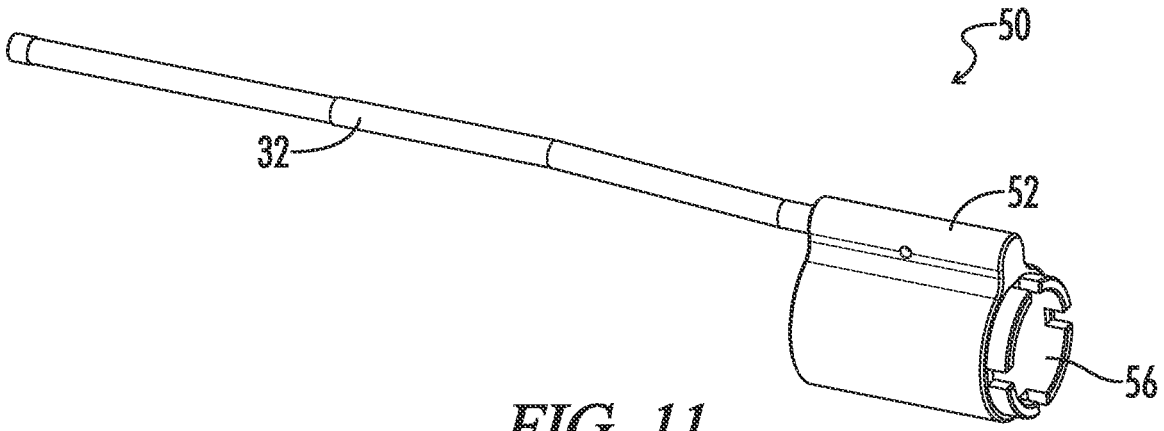
FIG. 11 is an elevated perspective view of one embodiment of a gas block for an AR-platform firearm constructed in accordance with the present invention showing a gas tube for the AR platform firearm received in the gas block.
Figure 12:
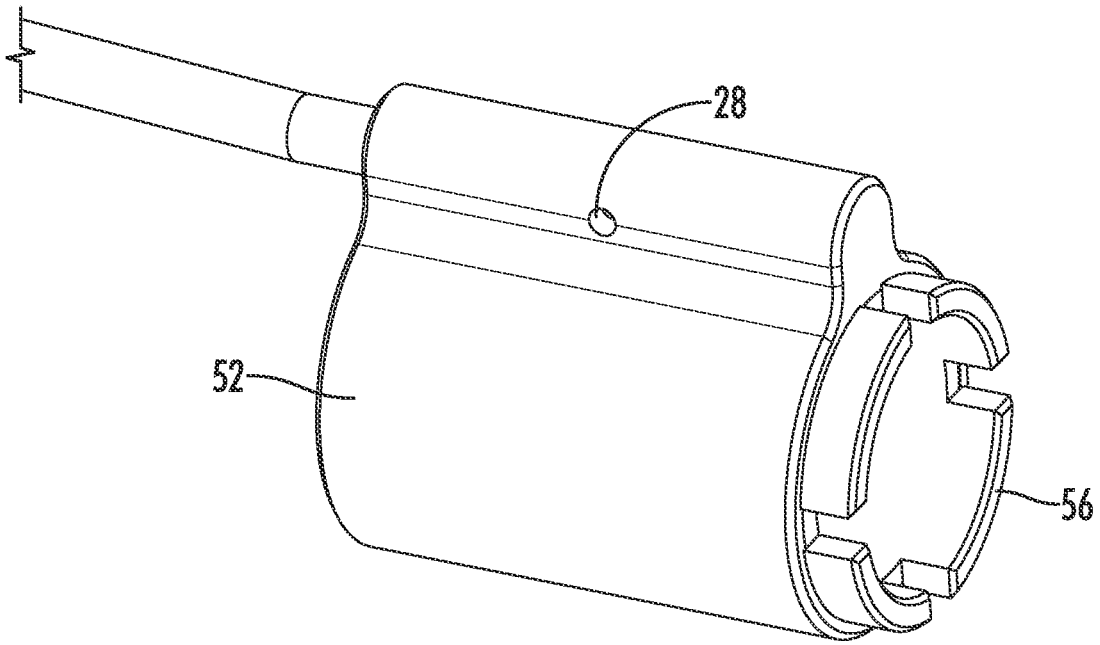
FIG. 12 is a close up isometric view of the objects of FIG. 11.
Figure 13:
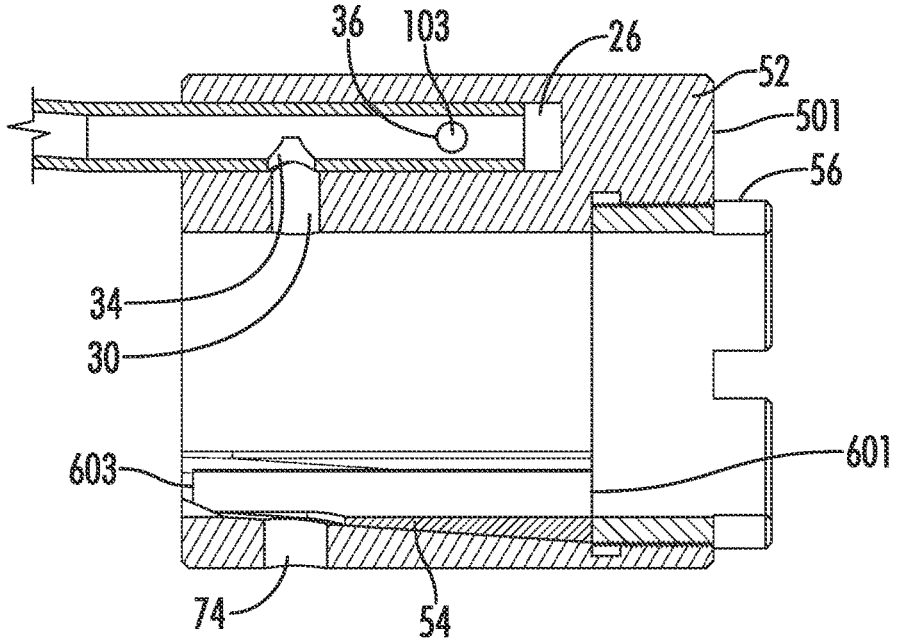
FIG. 13 is a side cutaway view of the objects of FIG. 11 taken vertically along the longitudinal axis of the gas block.
Figure 14:
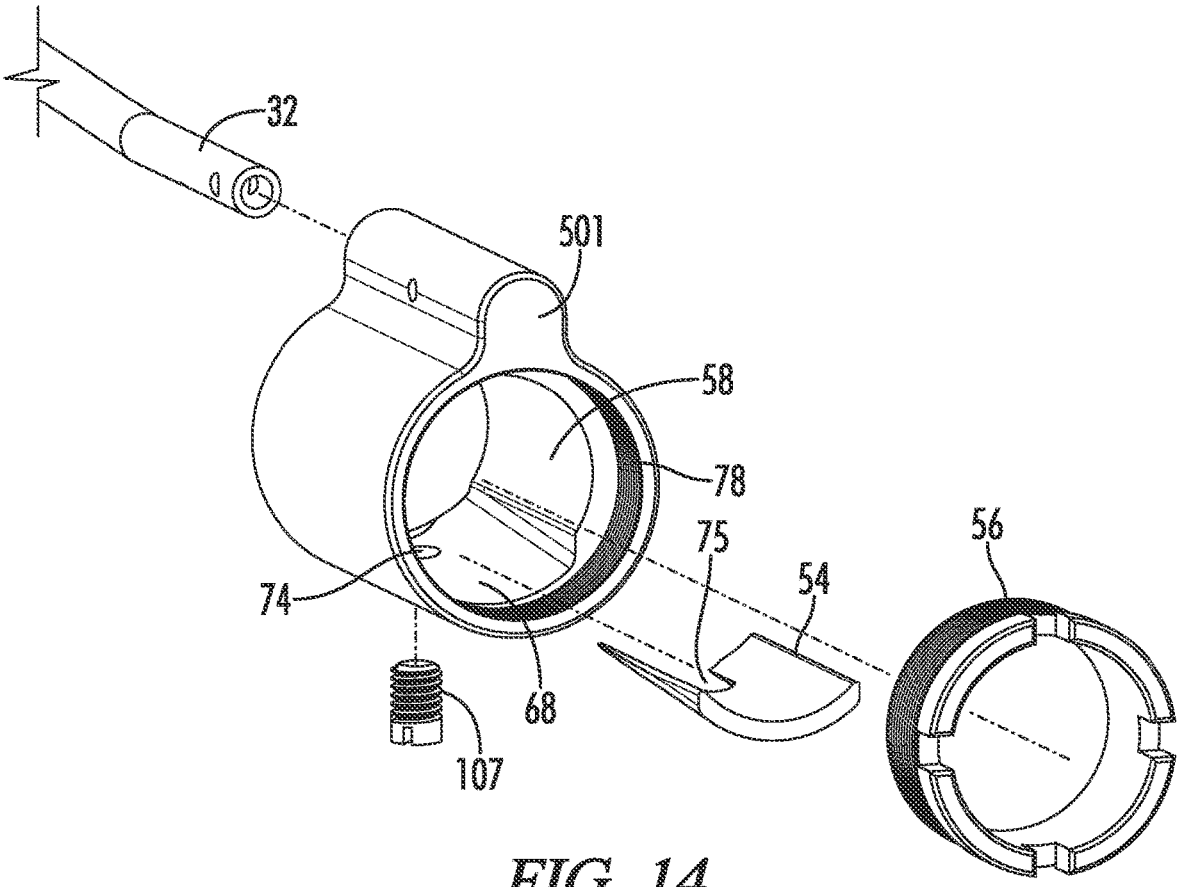
FIG. 14 is an exploded elevated front isometric view of the objects of FIG. 11.
Figure 15:
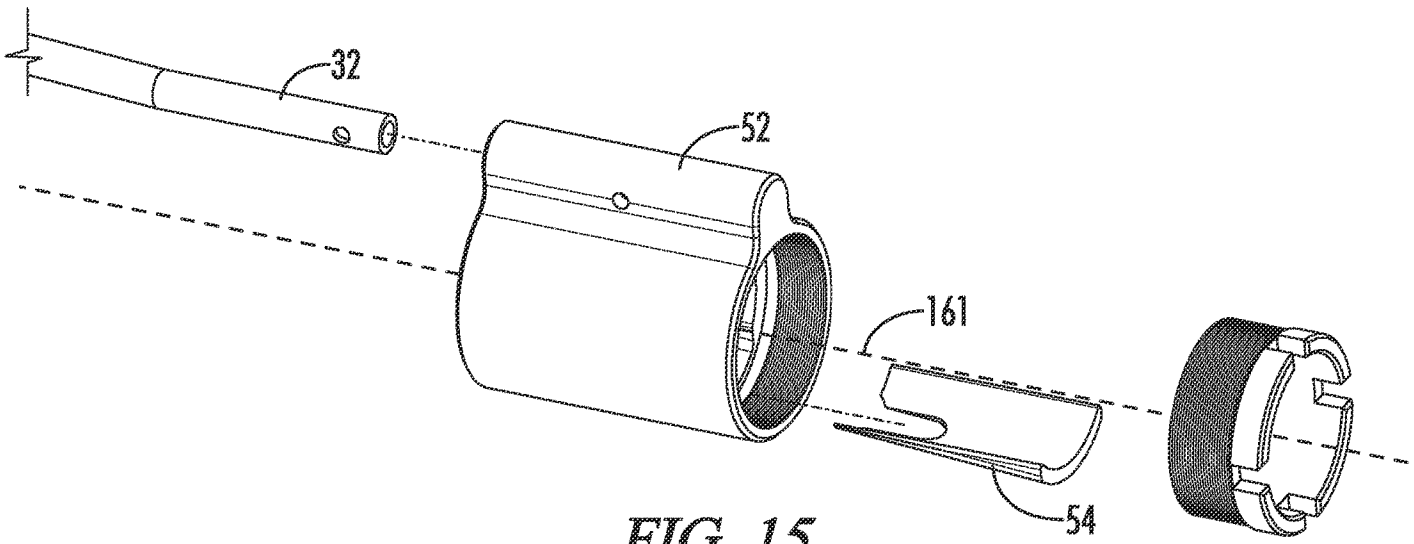
FIG. 15 is a side perspective exploded perspective view of the objects of FIG. 11.
Figure 16:
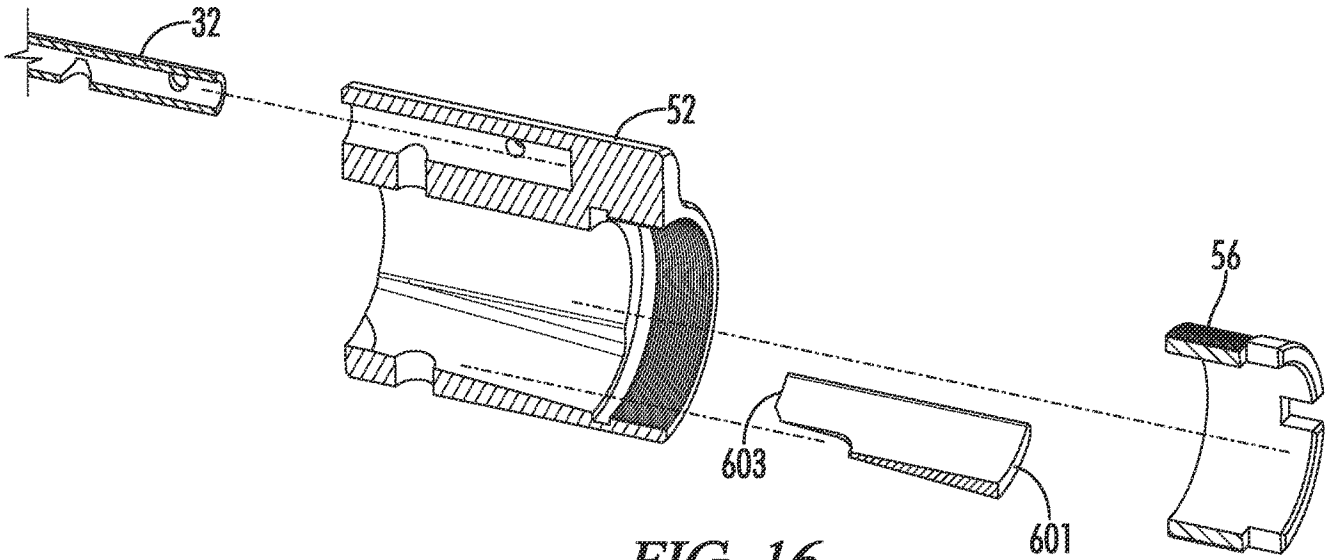
FIG. 16 is an exploded cutaway view of the objects of FIG. 11 taken vertically along the longitudinal axis of the gas block.
Figure 17:
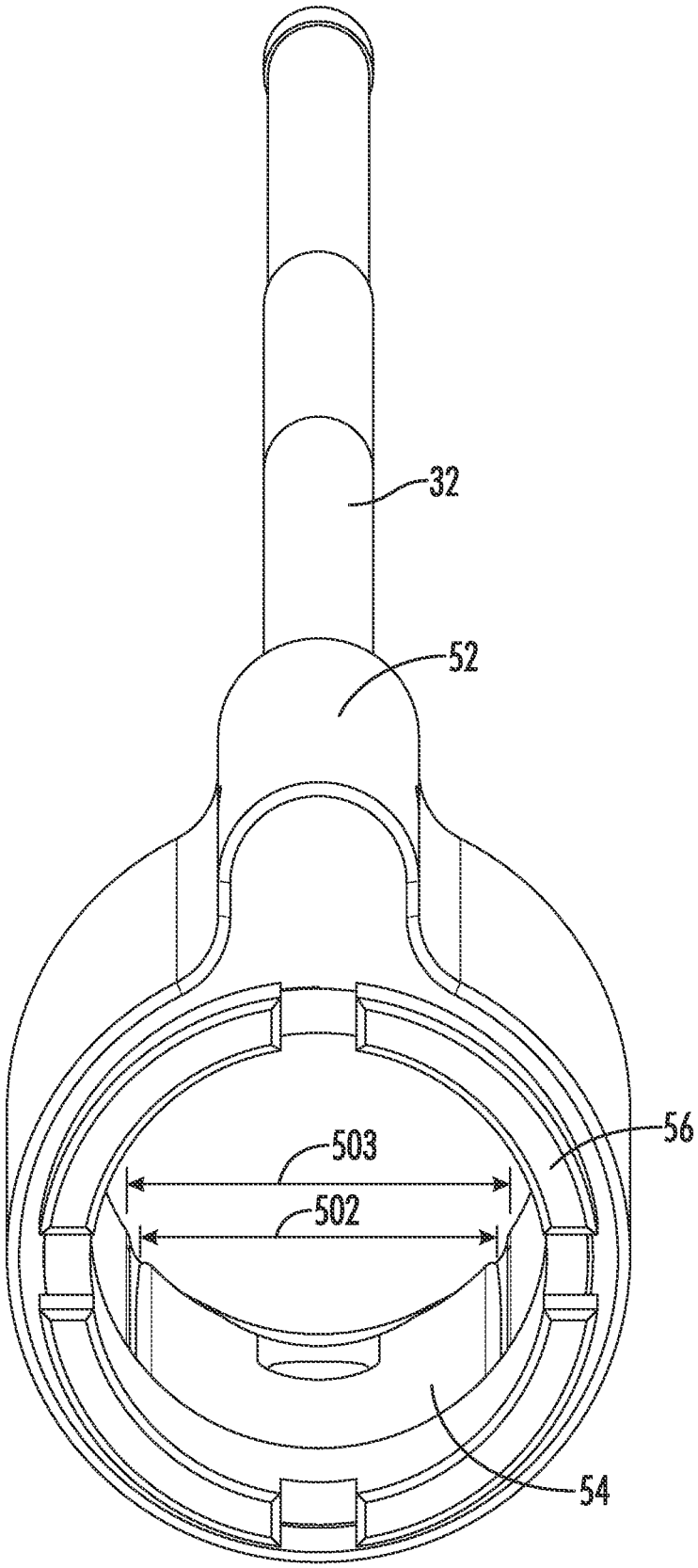
FIG. 17 is an elevated front perspective view of the objects of FIG. 11.

FIG. 4 depicts another exemplar prior art gas block 10*b* for an AR platform firearm. Gas block 10*b* is identical to gas block 10*a* in all aspects of form and function except as follows. The bottom wall of gas block 10*b* is split from the front surface 16 to the back surface 18 opposite the gas port 30 and gas tube passage 26 (i.e., in a bottom of the gas block 10*b*) such that the gas block 10*b* has a longitudinal gap 38. Additionally, instead of set screw holes 24, gas block 10*b* includes laterally extending pinch screw holes 40 in which pinch or clamp screws 42 are receivable. Tightening the screws 42 in the screw holes 40 when the barrel 20 is received in the barrel passage 12 causes the gap 38 in the bottom of the gas block 10*b* to begin to close, flexing lateral sides of the base block toward each other and thereby clamping the gas block 10*b* onto the barrel 20.

Referring now to FIGS. 5-10, a gas block 50 constructed according to one embodiment of the present invention is shown installed on the barrel 20 of the AR-platform firearm 101 with the gas tube 32 received therein. The gas block 50 includes a gas block body 52, a wedge or tapered collet 54, and an externally threaded nut 56 (e.g., a ram nut). The wedge 54 is configured to be at least partially received in the tapered recess 68 when the gas block 50 is installed on the firearm 101. The gas block body 52 includes a barrel passage 58 in which the barrel 20 is receivable, a gas tube passage 26 in which the gas tube 32 is receivable, a gas port 30 extending between the barrel passage 58 and the gas tube passage 26, and a retainer pin hole 28 extending laterally through the gas block body 52. In one embodiment, the gas tube passage 26 of the gas block body 52 is in fluid communication with the gas port 30 of the gas block body 52. In one embodiment, the barrel passage 58 is generally tubular, and the barrel passage 58 defines a longitudinal axis 14 that is coaxial with an axis of the barrel 20 when the gas block 50 is installed on the firearm 101 such that the barrel passage 58 is concentric about the longitudinal axis 14 when the gas block 50 is installed on the firearm 101. In one embodiment, the barrel passage 58 is located generally rearward of the tapered recess 68 when the gas block 50 is installed on the firearm 101. The gas block body 52 has a gas port 30 in the barrel passage 58 configured to align with the gas orifice 22 of the barrel 20 when the gas block 50 is installed on the firearm 101. A retainer pin hole 28 in the gas block body 52 intersects the gas tube passage 26 and aligns with the retainer pin hole 36 of the gas tube 32 when the gas tube 32 is received in the gas tube passage 26. A retainer pin 103 is receivable through the aligned retainer pin holes 28, 36 to retain the gas tube 32 in the passage 60. In one embodiment, the retainer pin hole 28 is a pair of opposing holes that intersect the gas tube passage 26 and extend opposite one another generally laterally therefrom. In one embodiment, the gas block body 52 is closed at a front end 501 of the gas tube passage 26. In one embodiment, gas block body 52 has flat opposing sides such that the gas block body 52 is compatible with a box end wrench or an open side oxygen sensor type open side wrench in order to hold the gas block body 52 in place (i.e., prevent rotation of the gas block body about the longitudinal axis 14) with said wrench while tightening the externally threaded nut 56 into the threaded aperture 78 with another wrench compatible with the externally threaded nut 56. In one embodiment, only the lateral sides of the gas block body 52 are flat.

In one embodiment, the gas block body 52 also defines a tapered recess 68 situated forward of and adjacent to the barrel passage 58. In one embodiment, the tapered recess 68 is generally rearward of the threaded aperture 78 when the gas block 50 is installed on the firearm 101. In one embodiment, the tapered recess 68 is concentric about longitudinal axis 14 and has an interior diameter which increases from a rear end 70 to a forward end 72 of the tapered recess 68. An interior diameter of the tapered recess 68 is equal to or greater than the interior diameter of the barrel passage 58 everywhere along the length of the tapered recess 68 from the rear end 70 to the forward end 72. In one embodiment, the wedge or collet 54 is receivable in the tapered recess 68 around the barrel 20 when the barrel 20 is received in the barrel passage 58.

In one embodiment, the gas block body 52 includes a threaded aperture 78 situated forward of and adjacent to the tapered recess 68. The threaded aperture 78 is concentric about longitudinal axis 14 when the gas block 50 is installed on the firearm 101. The threaded aperture 78 has an interior diameter at least as large as, if not greater than, the interior diameter of the tapered recess 68 at the rear end 72 of the tapered recess 68. The externally threaded ram nut 56 is receivable in the threaded aperture 78 around the barrel 20 through a front end 501 of the gas block body 52 and against the wedge or collet 54 when the collet 54 is received in the tapered recess 68 such that the externally threaded nut 56 is generally concentric with the longitudinal axis 14 when the gas block 50 is installed on the firearm 101.

In one embodiment, the wedge 54 or collet includes one or more longitudinal slots 55 defined therein. In one embodiment, the wedge 54 in circles and is generally concentric about the longitudinal axis 14 when the gas block 50 is installed on the firearm 101 such that the wedge 54 is a collet. The collet 54 has at least one slot 55 therein extending longitudinally such that the collet 54 can be compressed in diameter. The collet 54 has at least one slot therein extending longitudinally from a front end 601 of the collet 54 partially toward a rear end 603 of the collet 54. In one embodiment, the collet 54 has at least one slot 55 extending longitudinally from the rear end 63 of the collet 54 partially toward the front end 601 of the collet 54. In one embodiment, the call 54 has at least one slot therein extending longitudinally from the front end 601 to the rear end 603 of the collet 54 (e.g., a slot or slit).

Threading the ram nut 56 into the threaded aperture 78 against the wedge or collet 54 drives the collet 54 further into the tapered recess 68 (i.e., applies rearward pressure to the wedge 54 when the gas block 50 is installed on the firearm 101), which compresses the slots 55 and thereby tightens the collet 54 around the barrel 20 (i.e., reduces an internal diameter of the collet) to fix the gas block 50 in place on the barrel 20 via friction. The tighter the ram nut 56 is threaded into the threaded aperture 78, the more rearward force (i.e., generally parallel with the longitudinal axis 14 away from a muzzle 301 of the firearm 101) is applied to the wedge 54 and the more securely the gas block 50 is fixed to the barrel 20. This configuration more securely fixes the gas block 50 onto the barrel 20 than prior art gas blocks which rely on set screws (FIG. 1-3) or a pinch system (FIG. 4). The wedge system based gas block disclosed herein also provides a better seal around the barrel 20 to reduce or eliminate the escape of propellant gases from the gas orifice 22 through the barrel passage 58 out of the front of the gas block 50. Embodiments of the invention disclosed herein also allow a user to more easily index or align the gas orifice 22 of the barrel 20 with the gas port 30 and gas tube orifice 34.

In one embodiment, the gas block 50 includes one or more set screws 107 and set screw holes 74 defined at a bottom gas block body 52 radially opposite the gas port 30 to further facilitate even easier indexing and alignment of barrel gas orifice 22, gas port 30, and gas tube orifice 34. The presence of set screw hole 74 in gas block body 52 allows a user to thread the set screw 107 through the hole 74 while the barrel 20 is received in the passage 58 to lightly hold the gas block body 52 in position on the barrel 20 while the user manually indexes the gas block 50 to the firearm 101. Once the gas block body 52 is appropriately positioned, the set screw 107 can be tightened even further to better hold the gas block body 52 in position on the barrel 20 while the wedge 54 and externally threaded ram nut 56 are installed.

Referring now to FIGS. 11-17, another embodiment of a gas block 50 for an AR platform firearm 101 is shown. In this embodiment, the tapered recess 68 is formed in a bottom portion of the barrel passage 58. The tapered recess 68 has a slope, a radius of curvature, and a length which extends from a surface of the threaded aperture 78 to a surface of the passage 58. Wedge member 54 is receivable against the tapered recess 68 when the barrel 20 is received in the passage 58 to bias the barrel 20 against the surrounding inner surface of the passage 58 and thereby fix the gas block 50 in position on the barrel 20. In one embodiment, a keyway 75 shaped and sized to receive a set screw 107 is defined in a rear portion of wedge member 54. In one embodiment, the set screw hole 74 is radially opposite the gas port 30 of the gas block body 52. The keyway 75 is configured to align with the set screw hole 74 and allowed the set screw 107 inserted into the set screw hole 74 of the gas block body 52 to extend therethrough when the gas block 50 is installed on the firearm 101. In one embodiment, the tapered recess 68 extends longitudinally at least partially into the barrel passage 58. In one embodiment, the wedge 54 extends longitudinally forward and rearward of the gas port 30 of the gas block body 52 when the gas block 50 is installed on the firearm 101. In one embodiment, the tapered recess 68 is generally rearward of the threaded aperture 78 when the gas block 50 is installed on the firearm 101.

In one embodiment, the tapered recess 68 does not completely encircle the barrel 20 when the gas block 50 is installed on the firearm 101. In one embodiment, the tapered recess 68 is centered radially opposite the gas port 30 of the gas block body 52. In one embodiment, the wedge 54 has a circumferential extension 502 less than a circumferential extension 503 of the tapered recess 68. It is contemplated that the circumferential extension should be measured not as a straight line, but following a radius of curvature of the wedge 54 and the tapered recess 68.

In one embodiment, the externally threaded ram nut 56 is receivable in the threaded aperture 78 around the barrel 20 and against the wedge member 54 when the wedge member 54 is positioned on the tapered recess 68 under the barrel 20. Threading the ram nut 56 into the threaded aperture 78 against the wedge 54 drives or translates the wedge member 54 rearwardly up the tapered recess 68 (when the firearm 101 is in the upright position) between the exterior surface of the barrel 20 and the inner surface of gas block body 52 (i.e., surface of the tapered recess 68), thereby wedging the barrel 20 against the upper or top inner surface of the gas block body 52 and fixing the gas block 50 securely in place on the barrel 20 via a friction and/or compression fit. In one embodiment, the wedge 54 is secured at the forward end 601 of the wedge 54 then at the rear end 603 of the wedge 54 when the gas block 50 is installed on the firearm 101 such that the wedge 54 has a slope approximately equal to a slope of the tapered recess 68. In one embodiment, an interior radial dimension of the wedge 54 is generally constant. That is, if the wedge 54 completely encircled the barrel 20, an interior surface thereof would be generally tubular. In one embodiment, an external radial dimension of the wedge 54 is larger at the front end 601 of the wedge 54 than at the rear end 603 of the wedge 54 (e.g., the wedge 54 is wedge-shaped similar to a door wedge). In one embodiment, the wedge 54 extends longitudinally at least partially into the threaded aperture 78 of the gas block body 52 when the gas block 50 is installed on the fire 101, but the wedge 54 does not extend to the rear end 70 of the tapered recess 68 when the gas block 50 is installed on the firearm 101.

In one embodiment, system is reversed. That is, the externally threaded nut 56 is placed over the barrel 20 first with the threads thereof facing forward. The wedge 54 and gas block body 52 are then placed over the barrel 20 with the thicker edge of the wedge 54 at the rear end of the wedge 54. The wedge 54 is inserted into the gas block body from the rear of the gas block body 52, and the externally threaded nut is then tightened into the threaded aperture 78 forcing the wedge 54 forward and into greater contact with the tapered recess 68. In this embodiment, the threaded aperture 78 is thus rearward of the tapered recess 68 when the system 50 is assembled on the firearm 101.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful GAS BLOCK FOR A FIREARM, it is not intended that such references be construed as limitations upon the scope of this invention except as set forth in the following claims

What is claimed is:

1. A gas block for a firearm, said gas block comprising:

a gas block body comprising a barrel passage configured to receive a barrel of the firearm therethrough, a tapered recess, and a threaded aperture, wherein:

the barrel extends along a longitudinal axis, the gas block body extends along the longitudinal axis when the gas block is installed on the firearm, and the gas block body has a gas port in the barrel passage configured to align with a gas orifice of the barrel when the gas block is installed on the firearm;

a wedge configured to be at least partially received in the tapered recess when the gas block is installed on the firearm; and an externally threaded nut configured to engage the threaded aperture of the gas block body and press the wedge into the tapered recess when the gas block is installed on the firearm, wherein:

the tapered recess extends longitudinally at least partially into the barrel passage; the wedge extends longitudinally forward and rearward of the gas port of the gas block body when the gas block is installed on the firearm; the tapered recess is rearward of the threaded aperture when the gas block is installed on the firearm; the externally threaded nut is further configured to receive the barrel therethrough when the gas block is installed on the firearm; and the externally threaded nut is at least partially received in the gas block body through a forward end of the gas block body into the threaded aperture when the gas block is installed on the firearm.

2. The gas block of claim 1, wherein:

the externally threaded nut applies rearward longitudinal pressure to the wedge when the gas block is installed on the firearm;

rearward is parallel with the longitudinal axis away from a muzzle of the firearm toward a receiver of the firearm;

the barrel passage is tubular and is concentric with the longitudinal axis when the gas block is installed on the firearm;

the gas block body further comprises a gas tube passage configured to receive a gas tube of the firearm;

the gas tube passage of the gas block body is in fluid communication with the gas port of the gas block body;

the gas block body further comprises a retainer pin hole configured to receive a retainer pin of the firearm to retain the gas tube of the firearm in the gas tube passage of the gas block body when the gas block is installed on the firearm;

the retainer pin hole is a pair of opposing holes that intersect the gas tube passage and extend opposite one another laterally therefrom;

the externally threaded nut is concentric with the longitudinal axis when the gas block is installed on the firearm.

3. The gas block of claim 1, wherein:

the barrel passage is located rearward of the tapered recess when the gas block is installed on the firearm; and the tapered recess has a larger diameter at a forward end of the tapered recess than at a rear end of the tapered recess.

4. The gas block of claim 1, wherein:

the tapered recess does not completely encircle the barrel when the gas block is installed on the firearm;

the tapered recess is centered radially opposite a gas port of the gas block body; and the wedge has a circumferential extension slightly less than a circumferential extension of the tapered recess.

5. The gas block of claim 1, wherein:

the tapered recess does not completely encircle the barrel when the gas block is installed on the firearm;

the tapered recess is centered radially opposite a gas port of the gas block body;

the wedge has a circumferential extension slightly less than a circumferential extension of the tapered recess the tapered recess extends longitudinally at least partially into the barrel passage;

the gas block body further comprises a set screw hole radially opposite the gas port of the gas block body; and the wedge has a keyway configured to align with the set screw hole and allow a set screw inserted into the set screw hole of the gas block body to extend therethrough when the gas block is installed on the firearm.

6. The gas block of claim 1, wherein engaging the externally threaded nut with the threaded aperture when installing the gas block on the firearm induces a rearward force on the externally threaded nut, such that:

when the externally threaded nut contacts the wedge, the externally threaded nut and tapered recess cooperate to force the wedge into contact with the barrel of the firearm; and increasing torque applied to the externally threaded nut to tighten the externally threaded nut into the threaded aperture increases the force with which the wedge is pressed against the barrel.

7. The gas block of claim 1, wherein:

the wedge is thicker at a forward end of the wedge than at a rear end of the wedge when the gas block is installed on the firearm such that the wedge has a slope equal to a slope of the tapered recess;

an interior radial dimension of the wedge is generally constant; and an external radial dimension of the wedge is larger at the front end of the wedge than at the rear end of the wedge.

8. The gas block of claim 1, wherein:

the wedge extends longitudinally at least partially into the threaded aperture of the gas block body when the gas block is installed on the firearm; and the wedge does not extend to a rear end of the tapered recess when the gas block is installed on the firearm.

9. A firearm comprising:

a gas block, said gas block comprising:

a gas block body comprising a barrel passage configured to receive a barrel of the firearm therethrough, a tapered recess, and a threaded aperture, wherein:

the barrel extends along a longitudinal axis; axis, the gas block body extends along the longitudinal axis when the gas block is installed on the firearm, and the gas block body has a gas port in the barrel passage configured to align with a gas orifice of the barrel when the gas block is installed on the firearm;

a wedge configured to be at least partially received in the tapered recess when the gas block is installed on the firearm; and an externally threaded nut configured to engage the threaded aperture of the gas block body and press the wedge into the tapered recess when the gas block is installed on the firearm, wherein:

the wedge encircles and is concentric about the longitudinal axis when the gas block is installed on the firearm such that the wedge is a collet; the collet has at least one slot therein extending longitudinally such that the collet can be compressed in diameter; the collet has at least one slot therein extending longitudinally from a front end of the collet partially toward a rear end of the collet; the collet has at least one slot therein extending longitudinally from a rear end of the collet partially toward a front end of the collet; and the collet has at least one slot therein extending longitudinally from a front end to a rear end of the collet.

10. The firearm of claim 9, wherein:

the externally threaded nut applies rearward longitudinal pressure to the wedge when the gas block is installed on the firearm;

rearward is parallel with the longitudinal axis away from a muzzle of the firearm toward a receiver of the firearm;

the firearm further comprises the barrel having the muzzle;

the firearm further comprises the receiver;

the firearm further comprises a gas tube;

the firearm further comprises a buttstock extending rearward from the receiver and defining a rear of the firearm;

the barrel passage is tubular and is concentric with the longitudinal axis when the gas block is installed on the firearm;

the gas block body further comprises the gas tube passage configured to receive a gas tube of the firearm;

the gas tube passage of the gas block body is in fluid communication with the gas port of the gas block body;

the gas block body further comprises a retainer pin hole configured to receive a retainer pin of the firearm to retain the gas tube of the firearm in the gas tube passage of the gas block body when the gas block is installed on the firearm;

the firearm further comprises the retainer pin;

the retainer pin hole is a pair of opposing holes that intersect the gas tube passage and extend opposite one another laterally therefrom;

the firearm is an AR-platform firearm; and the externally threaded nut is concentric with the longitudinal axis when the gas block is installed on the firearm.

11. The firearm of claim 9, wherein:

the barrel passage is rearward of the tapered recess when the gas block is installed on the firearm;

the tapered recess is rearward of the threaded aperture when the gas block is installed on the firearm;

the externally threaded nut is further configured to receive the barrel therethrough when the gas block is installed on the firearm;

the externally threaded nut is at least partially received in the gas block body through a forward end of the gas block body into the threaded aperture when the gas block is installed on the firearm; and the tapered recess has a larger diameter at a forward end of the tapered recess than at a rear end of the tapered recess.

12. The firearm of claim 9, wherein engaging the externally threaded nut with the threaded aperture when installing the gas block on the firearm induces a rearward force on the externally threaded nut, such that:

when the externally threaded nut contacts the wedge, the externally threaded nut and tapered recess cooperate to force the wedge into contact with the barrel of the firearm; and increasing torque applied to the externally threaded nut to tighten the externally threaded nut into the threaded aperture increases the force with which the wedge is pressed against the barrel.

13. The firearm of claim 9, wherein:

the tapered recess completely encircles and is generally concentric about the longitudinal axis when the gas block is installed on the firearm.

14. The firearm of claim 9, wherein:

the wedge is thicker at a forward end of the wedge than at a rear end of the wedge when the gas block is installed on the firearm such that the wedge has a slope equal to a slope of the tapered recess;

an interior radial dimension of the wedge is constant;

an external radial dimension of the wedge is larger at the front end of the wedge than at the rear end of the wedge;

the wedge extends longitudinally at least partially into the threaded aperture of the gas block body when the gas block is installed on the firearm; and the wedge does not extend to a rear end of the tapered recess when the gas block is installed on the firearm.

15. A gas block for a firearm, said gas block comprising: a gas block body comprising a barrel passage configured to receive a barrel of the firearm therethrough, a tapered recess, and a threaded aperture, wherein: the barrel extends along a longitudinal axis, the gas block body extends along the longitudinal axis when the gas block is installed on the firearm, and the gas block body has a gas port in the barrel passage configured to align with a gas orifice of the barrel when the gas block is installed on the firearm; a wedge configured to be at least partially received in the tapered recess when the gas block is installed on the firearm; and an externally threaded nut configured to engage the threaded aperture of the gas block body and press the wedge into the tapered recess when the gas block is installed on the firearm, wherein: the barrel passage, the tapered recess, and the threaded aperture are coaxial; the wedge is thicker at a forward end of the wedge than at a rear end of the wedge when the gas block is installed on the firearm such that the wedge has a slope equal to a slope of the tapered recess; an interior radial dimension of the wedge is constant; and an external radial dimension of the wedge is larger at the front end of the wedge than at the rear end of the wedge.

* * * * *